US005653507A

United States Patent [19]

Moore

[11] Patent Number: 5,653,507

[45] Date of Patent: Aug. 5, 1997

[54] MODULAR CHURCH PEW SYSTEM

[75] Inventor: Lorraine Moore, Cameron, Tex.

[73] Assignee: Balt/Trinity, Cameron, Tex.

[21] Appl. No.: 538,352

[22] Filed: Oct. 3, 1995

[51] Int. Cl.[6] ..... A47C 7/00

[52] U.S. Cl. ..... 297/440.14; 297/440.1; 297/248; 297/452.19; 297/188.08

[58] Field of Search ..... 297/440.14, 233, 297/187, 188.04, 188.08, 450.1, 452.19, 452.18, 248, 440.1

[56] References Cited

U.S. PATENT DOCUMENTS

| | | | |
|---|---|---|---|
| 2,164,715 | 7/1939 | Krainbill | 297/440.14 X |
| 2,489,087 | 11/1949 | Hewit, Jr. | 297/188.08 |
| 2,518,532 | 8/1950 | Edwards | 297/450.1 |
| 2,532,863 | 12/1950 | Taylor | 297/188.08 X |
| 2,593,270 | 4/1952 | Clifton | 297/450.1 X |
| 3,091,497 | 5/1963 | Houser | 297/452.14 |
| 3,318,635 | 5/1967 | Barecki et al. | 297/452.18 X |
| 3,511,536 | 5/1970 | Suzuki | 297/450.1 X |
| 3,610,686 | 10/1971 | Caruso | 297/450.1 X |
| 3,614,157 | 10/1971 | Hendrickson et al. | 297/248 |
| 3,620,567 | 11/1971 | Hendrickson et al. | 297/248 |
| 3,674,311 | 7/1972 | Miller | 297/248 |
| 3,973,800 | 8/1976 | Kogan | 297/248 X |
| 4,318,570 | 3/1982 | Adams et al. | 297/450.1 |
| 4,348,052 | 9/1982 | Roland | 297/450.1 X |
| 5,282,669 | 2/1994 | Barile | 297/248 |
| 5,314,234 | 5/1994 | England | 297/248 |
| 5,451,092 | 9/1995 | Gray | 297/440.1 X |
| 5,544,938 | 8/1996 | Saul et al. | 297/248 |

FOREIGN PATENT DOCUMENTS

| | | | |
|---|---|---|---|
| 1291159 | 3/1962 | France | 297/440.14 |
| 2328233 | 12/1973 | Germany | 297/440.1 |
| 381893 | 10/1932 | United Kingdom | 297/232 |
| 1060366 | 3/1967 | United Kingdom | 297/248 |

*Primary Examiner*—Milton Nelson, Jr.
*Assistant Examiner*—David E. Allred
*Attorney, Agent, or Firm*—Wendy K. Buskop; Chamberlain, Hrdlicka et al.

[57] ABSTRACT

A modular pew system comprises a pew section and a panel member. The pew section has a first end and a second end. The pew section is formed from a seat section and a back section. The seat section and the back section each have a first end and a second end which correspond to the first end and the second end of the pew section. A first half of a first slidable fastener is positioned on the first end of the seat section. A first half of a second slidable fastener is positioned on the first end of the seat section. The first panel member has a shape to form an end facade for the pew section. The panel member has a first side surface and a second side surface. A second half of the first slidable fastener is positioned on the first side surface of the first panel member to engage the first half of the first slidable fastener. A second half of the second slidable fastener is positioned on the first side surface of the first panel member to engage with first half of the first slidable fastener. As many pew sections as desired can be attached together depending on the needs of the customer.

9 Claims, 3 Drawing Sheets

MODULAR CHURCH PEW SYSTEM

BACKGROUND OF THE INVENTION

The invention relates to modular furniture. In one aspect, the invention relates to a modular church pew.

In the past, church pews had to be custom constructed, since churches are not of a uniform width. Custom construction is expensive. A church pew which is not required to be custom constructed would be very desirable.

Church pews are customarily bolted to the floor, making the initial layout of the church permanent. Congregations with limited space and resources, or those who rent space have had to use folding chairs during services. A church pew that can be moved around to fit the space and needs of the individual church would be very desirable.

Church pews are often of great length and weight. Because of this, they were difficult to transport. A church pew which could be transported in small pieces and assembled on site would be very desirable.

Church sizes change. Also, meeting places change. A church pew easily reduced or extended in length would be very desirable. A church pew which could be easily modified in appearance would also be very desirable.

OBJECTS OF THE INVENTION

It is an object of this invention to provide a modular church pew which overcomes the problems noted above.

SUMMARY OF THE INVENTION

In one embodiment of the invention, there is provided a modular pew system. The system comprises a pew section and a panel member. The pew section has a first end and a second end. The pew section is formed from a seat section and a back section. The seat section and the back section each have a first end and a second end which correspond to the first end and the second end of the pew section. A first half of a first slidable fastener is positioned on the first end of the back section. A first half of a second slidable fastener is positioned on the first end of the seat section. The first panel member has a shape to form an end facade for the pew section. The panel member has a first side surface and a second side surface. A second half of the first slidable fastener is positioned on the first side surface of the first panel member to engage the first half of the first slidable fastener. A second half of the second slidable fastener is positioned on the first side surface of the first panel member to engage the first half of the second slidable fastener.

In another embodiment of the invention, there is provided a modular pew. The pew comprises a first pew section, a first panel member, a second panel member and means for connecting the first pew section with the second panel member. The pew section has a first end and a second end. The pew section is formed from a seat section and a back section. Each of the seat section and the back section has a first end and a second end which correspond to the first end and the second end of the pew section. A first half of a first slidable fastener is positioned on the first end of the back section. A first half of a second slidable fastener is positioned on the first end of the seat section. The first panel member has a shape to form an end facade for the first end of the pew section. The first panel member has a first side surface and a second side surface. A second half of the first slidable fastener is positioned on the first side surface of the first panel member and engages the first half of the first slidable fastener. A second half of the second slidable fastener is positioned on the first side surface of the first panel member and engages the first half of the second slidable fastener. The second panel member has a shape to form an end facade for the second end of the pew section. The second panel member has a first side surface and a second side surface. A second half of the first slidable fastener is positioned on the first side surface of the second panel member. A second half of the second slidable fastener is positioned on the first side surface of the second panel member. Means is provided for connecting the second end of the pew section with the second panel member.

DETAILED DESCRIPTION OF THE PREFERRED EMBODIMENTS

Figure 1:
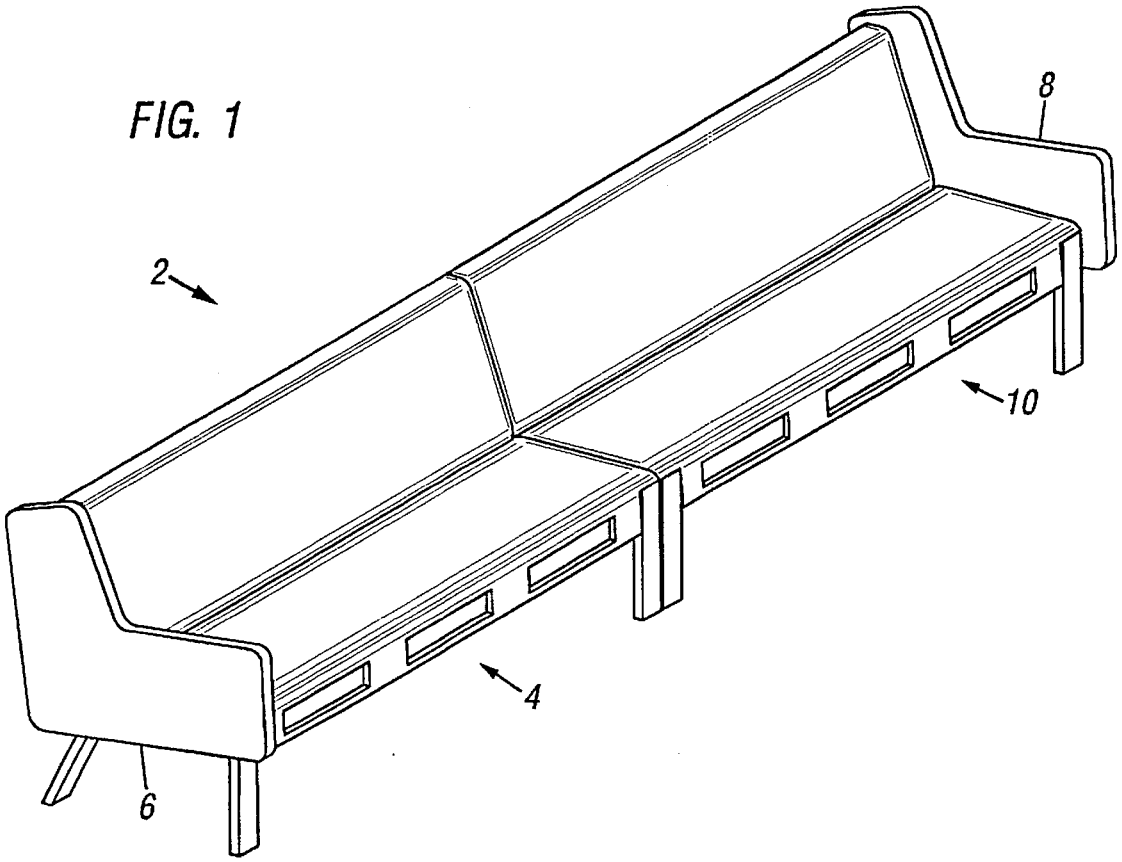
FIG. 1 is a pictorial representation of a church pew according to certain embodiments of the invention.

With reference to FIG. 1, a modular pew 2 comprises a first pew section 4, a first panel member 6, a second panel member 8 and means 10 for connecting the first pew section 4 with the second panel member 8. The pew section 4 has a first end 12 and a second end 14.

Figure 2:
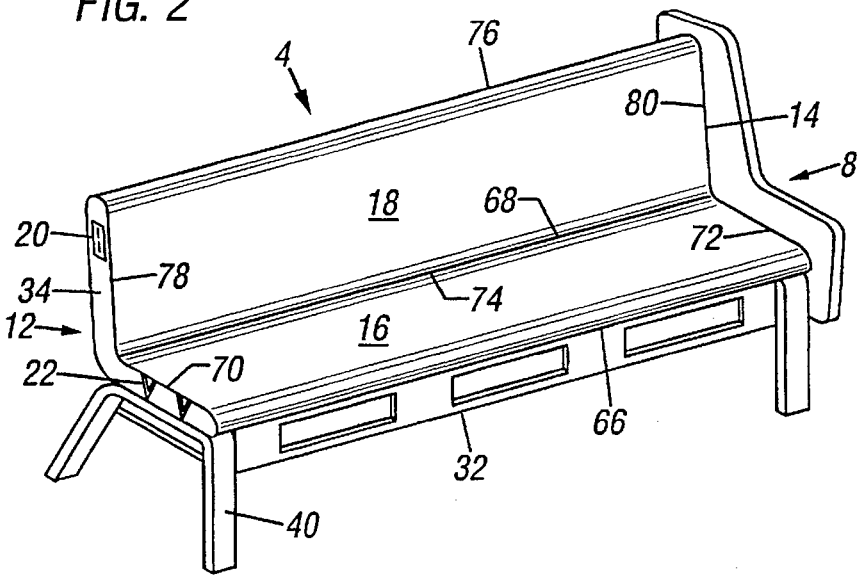
FIG. 2 is a pictorial representation of a portion of the church pew shown in FIG. 1.

Referring to FIG. 2, the pew section 4 is formed from a seat section 16 and a back section 18. Each of the seat section and the back section has a first end and a second end which correspond to the first end 12 and the second end 14 of the pew section. A first half 20 of a first slidable fastener is positioned on the first end of the back section 18. A first half 22 of a second slidable fastener is positioned on the first end of the seat section 16.

Figure 3:
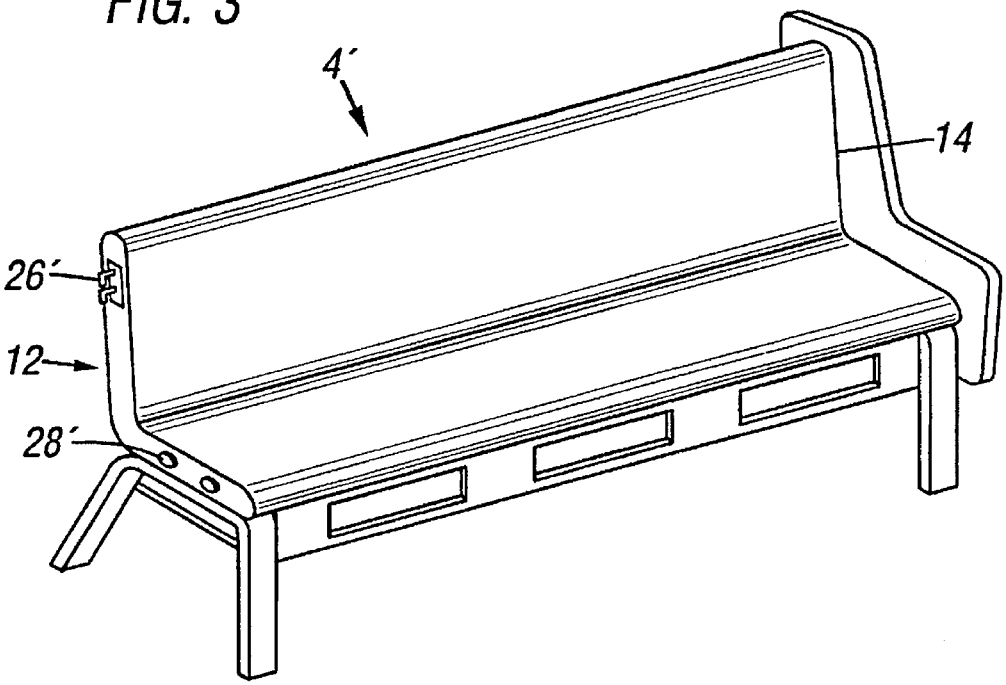
FIG. 3 is a pictorial representation of a second portion of the church pew shown in FIG. 1.
Figure 4:
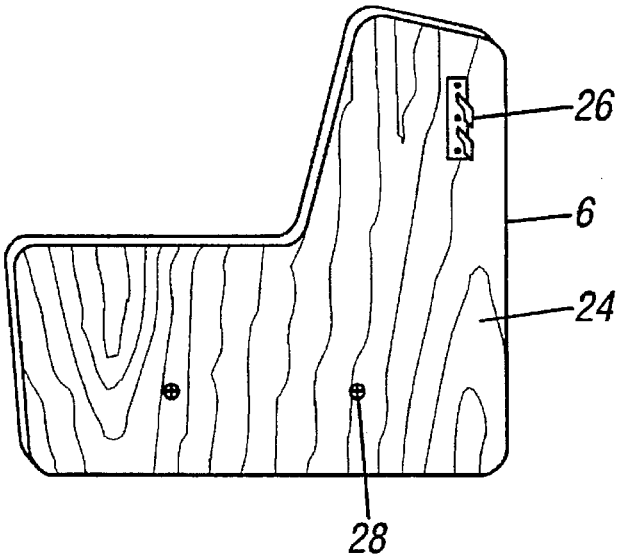
FIG. 4 is a perspective view of a portion of the pew shown in FIG. 1.

Referring to FIG. 4, the first panel member 6 has a shape to form an end facade for the first end 12 of the pew section 4. The first panel member 6 has a first side surface 24 and a second side surface. The second half 26 of the first slidable fastener is positioned on the first side surface 24 of the first panel member 6 and engages the first half 20 of the first slidable fastener shown in FIG. 3. A second half 28 of the second slidable fastener is positioned on the first side surface 24 of the first panel member 6 and engages the first half 22 of the second slidable fastener shown in FIG. 3.

Figure 5:
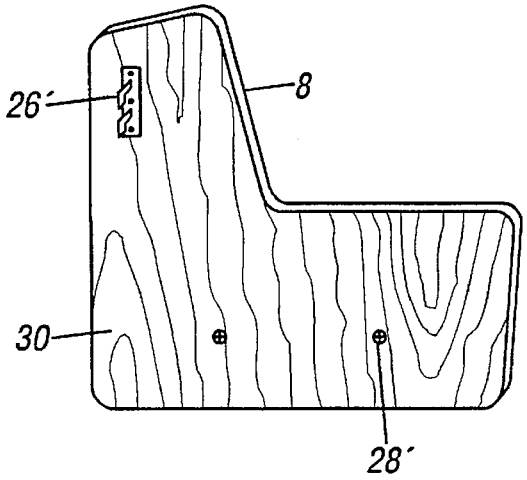
FIG. 5 is a perspective view of a portion of the pew shown in FIGS. 1, 2 and 3.

Referring to FIG. 5, the second panel member 8 has a shape to form an end facade for the second end 14 of the pew section. The second panel member 8 has a first side surface 30 and a second side surface. A second half 26' of the first slidable fastener is positioned on the first side surface 30 of the second panel member 8. A second half 28' of the second slidable fastener is positioned on the first side surface 30 of the second panel member 8. Means 10 is provided for connecting the second end 14 of the pew section 4 with the second panel member 8.

Generally speaking, the means 10 can be fasteners mounted on the second end 14 of the pew section 4, or a second pew section 4' carrying suitable fasteners.

With reference to FIG. 2, where the means 10 comprises fasteners, a first half 20' of a first slidable fastener is positioned on the second end of the back section 18 so as to be engagable with the second half 26' (see FIG. 5) of the first slidable fastener positioned on the first side surface 30 of the second panel member 8 and a first half 22' of a second slidable fastener positioned on the second end of the seat section 16 so as to be engagable with the second half 28' of the second slidable fastener positioned on the first side surface 30 of the second panel member 8.

With reference to FIG. 3, where the means 10 comprises a second pew section carrying fasteners, a second pew section 4' which can be as shown in FIG. 3 is employed. The second pew section 4' is preferably identical to the first pew section 4. The second pew section 4' has a second half 26' of a first slidable fastener positioned on the first end of the back section 18' and a second half 28' of a second slidable fastener positioned on the first end of the seat section 16' as shown in FIG. 3 so as to be engagable with the first half 20' of the first slidable fastener positioned on the second end of the back section 18 of the first pew section 4 and the first half 22' of the second slidable fastener positioned on the second end of the seat section 16 of the first pew section 4 as shown in FIG. 2.

The second pew section 4' has a first half 20' of a first slidable fastener positioned on the second end of the back section 18' as shown in FIG. 2 so as to be engagable with the second half 26' of the first slidable fastener positioned on the first side surface 30 of the second panel member 8 as shown in FIG. 5 and a first half 22' of a second slidable fastener positioned on the second end of the seat section 16' as shown in FIG. 2 so as to be engagable with the second half 28' of the second slidable fastener positioned on the first side surface 30 of the second panel member 8 as shown in FIG. 5.

One of the benefits of the invention is the provision of a modular pew system that can be adjusted in length to fit any size room. The modular system comprises a pew section 4 and a panel member 6, 8 as shown in FIGS. 2 or 3 for example. The pew section 4 has a first end 12 and a second end 14. The pew section 4 is formed from a seat section 16 and a back section 18. The seat section 16 and the back section 18 each have a first end and a second end which correspond to the first end and the second end of the pew section 4. A first half 20 of a first slidable fastener is positioned on the first end of the back section 18. A first half 22 of a second slidable fastener is positioned on the first end of the seat section 16. The first panel member 6 has a shape to form an end facade for the pew section 4. The panel member 6 has a first side surface 24 and a second side surface. A second half 26 of the first slidable fastener is positioned on the first side surface 24 of the first panel member 6 to engage the first half 20 of the first slidable fastener. A second half 28 of the second slidable fastener is positioned on the first side surface 24 of the first panel member 6 to engage to first half 22 of the second slidable fastener.

A first half 20' of a first slidable fastener is also positioned on the second end of the back section 18 of the first pew section 4 and a first half 22' of a second slidable fastener is also positioned on the second end of the seat section 16 of the first pew section 4. By providing additional pew sections 4' which have a second half 26' of a first slidable fastener positioned on the first end of the back section, a second half 28' of a second slidable fastener positioned on the first end of the seat section, a first half 20' of a first slidable fastener positioned on the second end of the back section, and a first half 22' of a second slidable fastener positioned on the second end of the seat section, as many pew sections can be attached together as desired. Also, each pew section can be sized to accommodate as many people as is desired. For ease of handling, however, it is preferred that the pew sections be sized to be between about 50.8 cm (20 inches) and 152.4 cm (60 inches) in length, which will accommodate one, two, or three people. Once the desired number of pew sections have been attached to the first pew section, the second panel member is attached.

In a preferred embodiment of the invention, and with reference to FIG. 4, the second half 26 of the first slidable fastener comprises a male hook member. With reference to FIG. 3, the first half 20 of the first slidable fastener comprises a female member having a slot for receiving the male hook member of the first half. With reference to FIG. 4, the second half 28 of the second slidable fastener comprises a male hook member. With reference to FIG. 3, the first half 22 of the second slidable fastener comprises a female member having a slot for receiving the male hook member of the first half of the second slidable fastener. The first fastener and the second fastener preferably, when being in the engaged position, substantially prevent longitudinal movement between the pew sections, or between a pew section and a panel member.

For ease of assembly, it is preferred that the first half of each first slidable fastener and each second slidable fastener is positioned so that the male hook member of the second half of each of the first slidable fastener and the second slidable fastener slides in a generally vertical direction when moving into the engaged position.

In an embodiment of the invention that has been used with good results, the second half 26 of each first slidable fastener comprises a male bed hook and the second half 28 of each second slidable fastener comprises a pin having a flange. The first half 20 of each first slidable fastener comprises a plate having an outside surface, and inside surface, and a slot therethrough for detachably receiving the male bed hook, and the first half 22 of each second slidable fastener comprises a plate having a slot and a V shaped notch for detachably receiving the pin having the flange.

Figure 6:
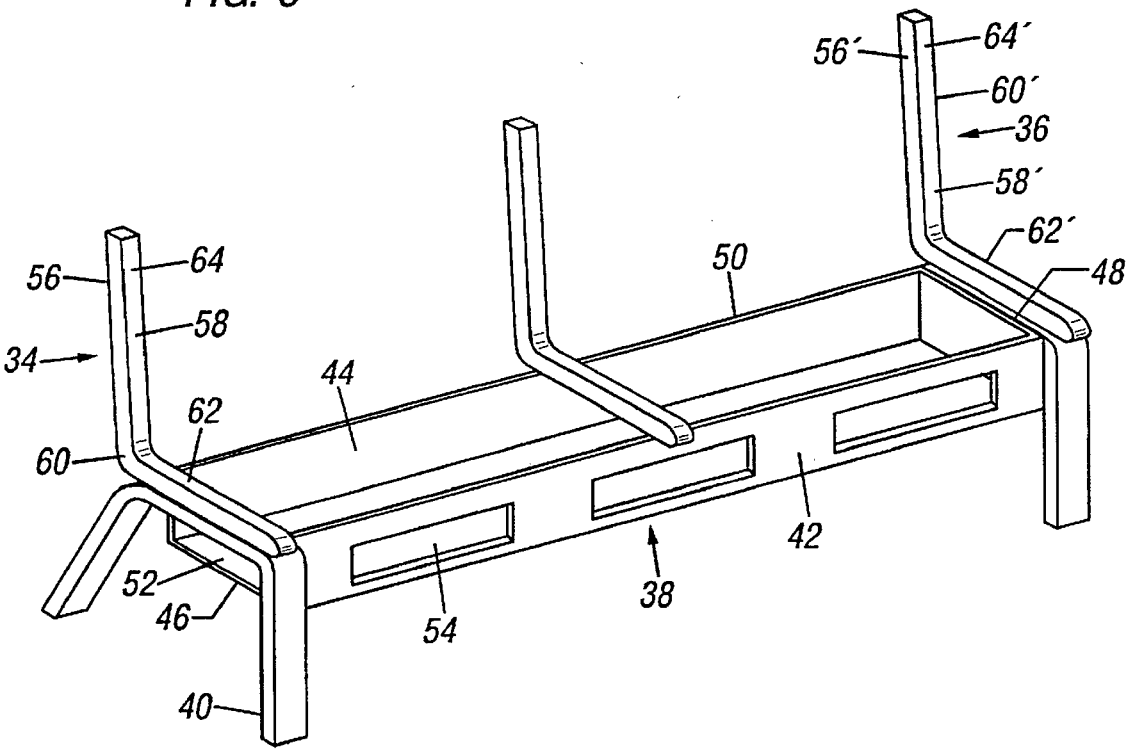
FIG. 6 is a pictorial representation of a frame structure of the pew section shown in FIGS. 1, 2 and 3.

Referring to FIGS. 2 and 6, the pew section can be formed from a base frame 32, a first generally L-shaped support section 34, a second generally L shaped support section 36, a substantially horizontal seating section 16 and a generally vertical backrest section 18.

The base frame has a substantially horizontal box shaped top section 38 and a plurality of legs 40. The box shaped top section has a generally vertical front surface 42, a generally vertical back surface 44, a first side end 46, a second side end 48, a top end 50 and a bottom surface 52. In a preferred embodiment, the generally vertical front section 42 contains a plurality of substantially rectangular holes 54 which allow book to be passed into and out of the box shaped top section 38.

The first generally L shaped support section 34 has a bottom surface 56, a top surface 58 substantially opposite the bottom surface, an outside end 60, a first leg 62 and a second leg 64. The bottom surface 56 of the first leg 62 is attached to the top end 50 of the top section 38 of the base frame 32 at the first end 46 of the top section.

The second generally L shaped support section 36 is substantially identical to the first L shaped support section 34, having a bottom surface 56', a top surface 58', an outside end 60', a first leg 62' and a second leg 64'. The bottom surface 56' of the first leg 62' is attached to the top end 50 of the top section 38 of the base frame 32 at the second end 48 of said top section.

The first leg 62, 62' of the first L shaped support section 34 and the second L shaped support section 36 is contained in a first common plane and the second leg 64, 64' of the first L shaped support section 34 and said second L shaped support section 36 is contained in a second common plane positioned upwardly away from the top section of the base frame at an angle of about 95 to 110 degrees.

Referring again FIG. 2, the substantially horizontal seating section has a front edge 66, a back edge 68, a first side edge 70, a second side edge 72, a top surface and a bottom surface. The bottom surface is attached to the top surface 58, 58' of the first leg 62, 62' of each of the first L shaped support section 34 and the second L-shaped support section 36.

The generally vertical backrest section 18 has a front edge 74, a back edge 76, a first side edge 78, a second side edge 80, a front surface and a back surface. The back surface is attached to the top surface 58, 58' of the second leg 64, 64' of each of the first L shaped support section 34 and the second L shaped support section 36.

A first half 20 of the first slidable fastener and a first half 22 of the second slidable fastener is positioned in the outside ends 60, 60' of both said first generally L shaped support section 34 and said second generally L shaped support section 36.

The first side edge 70 of the seating section 16 and the first side edge 78 of the backrest section 18 are substantially coplanar with the outside end 58 of the first generally L shaped support section 34. The second side edge 72 of the seating section 16 and the second edge 78 of the backrest section 18 are substantially coplanar with the outside end 58' of the second generally L shaped support section 36. In a preferred embodiment, the first halves 20, 22 of the first and second fasteners are positioned in the outside ends 58, 58' of the L shaped support sections 34, 36 rather than in the ends of the backrest and seating sections.

The pew sections may be made from any material. It has been found that fabricating the L shaped support sections and plurality of legs from bentwood provides good results. The box shaped top section of the base frame and the panel members have been successfully made from 21 ply MDF board. Also, good results have been obtained when the backrest section and seating section were fabricated from board with a foam cushion and outer layer of upholstery cloth. However, the backrest section and seating section could also be fabricated out of one or more pieces of bentwood, for a more "courtroom bench" effect. It has also been found that forming a downwardly extending lip on the front end of the seating section provides both greater comfort and aesthetics to the pew. Optional book racks, pen and envelope holders and collection cup holders may be attached to the back side of the backrest section. An optional kneel board may also be attached to the legs of the base frame.

While certain preferred embodiments of the invention have been described herein, the invention is not to be construed as so limited, except to the extent such limitations are found in the claims.

I claim:

1. A modular pew system comprising:

a pew section having a first end and a second end, said pew section being formed from a seat section and a back section each having a first end and a second end which correspond to the first end and the second end of the pew section;

wherein a first half of a first slidable fastener is positioned on the first end of the back section and a first half of a second slidable fastener is positioned on the first end of the seat section; and a first panel member having a shape to form an end facade for the first end of the pew section, said panel member having a first side surface and a second side surface;

wherein a second half of the first slidable fastener is positioned on the first side surface of the first panel member to engage the first half of the first slidable fastener, and a second half of the second slidable fastener is positioned on the first side surface of the first panel member to engage with the first half of the second slidable fastener;

a first half of a first slidable fastener positioned on the second end of the back section of the pew section and a first half of a second slidable fastener positioned on the second end of the seat section of the pew section;

a second panel member having a shape to form an end facade for the second end of the pew section, said second panel member having a first side surface and a second side surface, wherein a second half of a first slidable fastener is positioned on the first side surface of the second panel member to engage the first half of the first slidable fastener positioned on the second end of the back section of the pew section, and a second half of a second slidable fastener is positioned on the first side surface of the second panel member to engage the first half of the second slidable fastener positioned on the second end of the seat section of the pew section, wherein the second half of the first slidable fastener comprises a male hook member and the first half of the first slidable fastener comprises a female member having a slot for receiving the male hook member of the second half of the first slidable fastener, and the second half of the second slidable fastener comprises a male hook member and the first half of the second slidable fastener comprises a female member having a slot for receiving the male hook member of the second half of the second slidable fastener, said first fastener and said second fastener, when being in an engaged position, substantially preventing longitudinal movement therebetween, wherein the first half of the first slidable fastener and the first half of the second slidable fastener are positioned so that the male hook member of the second half of the first slidable fastener and the male hook member of the second half of the second slidable fastener slide in a generally vertical direction when moving into the engaged position;

wherein the pew section further comprises:

a base frame having a substantially horizontal box shaped top section, said box shaped top section having a generally vertical front surface, a generally vertical back surface, a first side end, a second side end, a top end and a bottom surface, and a plurality of legs extending downwardly from the bottom surface of the box shaped top section;

a first generally L shaped support section, having a bottom surface, a top surface, an outside end, a first leg and a second leg, said bottom surface of the first leg attached to the top end of the top section of the base frame at the first end of said top section;

a second generally L shaped support section substantially identical to the first L shaped support section, having a bottom surface, a top surface, an outside end, a first leg and a second leg, said bottom surface of the first leg attached to the top end of the top section of the base frame at the second end of said top section;

wherein the first leg of the first L shaped support section and the first leg of said second L shaped support section are contained in a first common plane and the second leg of the first L shaped support section and the second leg of said second L shaped support section are contained in a second common plane positioned upwardly away from the top section of the base frame at an angle of 95 to 110 degrees;

a substantially horizontal seating section having a front edge, a back edge, a first side edge, a second side edge, a top surface and a bottom surface, said bottom surface attached to the top surface of the first leg of each of the first L shaped support section and the second L-shaped support section;

a generally vertical backrest section having a front edge, a back edge, a first side edge, a second side edge, a front surface and a back surface, said back surface attached to the top surface of the second leg of each of the first L shaped support section and the second L shaped support section;

wherein a first half of the first slidable fastener and a first half of the second slidable fastener are positioned in each of the outside ends of said first generally L shaped support section and said second generally L shaped support section respectively;

wherein the first side edge of the seating section and the first side edge of the backrest section are substantially coplanar with the outside end of the first generally L shaped support section; and wherein the second side edge of the seating section and the second edge of the backrest section are substantially coplanar with the outside end of the second generally L shaped support section.

2. Apparatus as in claim 1 wherein the first half of each first slidable fastener comprises a male bed hook and the first half of each second slidable fastener comprises a pin having a flange, and the second half of each first slidable fastener comprises a plate having an outside surface, and inside surface, and a slot therethrough for detachably receiving the male bed hook, and the second half of each second slidable fastener comprises a plate having a slot and a V shaped notch for detachably receiving the pin having the flange.

3. Apparatus as in claim 2 wherein the horizontal front surface of said box shaped top section has a plurality of substantially rectangular holes, said rectangular holes allowing books to pass into and out of the box shaped top section.

4. A modular pew comprising:

a first pew section having a first end and a second end, said pew section being formed from a seat section and a back section each having a first end and a second end which correspond to the first end and the second end of the pew section;

wherein a first half of a first slidable fastener is positioned on the first end of the back section and a first half of a second slidable fastener is positioned on the first end of the seat section;

a first panel member having a shape to form an end facade for the first end of the pew section, said first panel member having a first side surface and a second side surface;

wherein a second half of the first slidable fastener is positioned on the first side surface of the first panel member and engages the first half of the first slidable fastener, and a second half of the second slidable fastener is positioned on the first side surface of the first panel member and engages the first half of the second slidable fastener;

a second panel member having a shape to form an end facade for the second end of the pew section, said second panel member having a first side surface and a second side surface;

wherein a second half of the first slidable fastener is positioned on the first side surface of the second panel member and a second half of the second slidable fastener is positioned on the first side surface of the second panel member; and means for connecting the second end of the pew section with the second panel member, wherein the means for connecting the second end of the pew section with the second panel member comprises a first half of a first slidable fastener positioned on the second end of the backrest section so as to be engagable with the second half of the first slidable fastener positioned on the first side surface of the second panel member and a first half of a second slidable fastener positioned on the second end of the seat section so as to be engagable with the second half of the second slidable fastener positioned on the first side surface of the second panel member;

wherein the means for connecting the second end of the pew with the second panel member further comprises:

a second pew section having a first end and a second end, said second pew section being formed from a seat section and a back section each having a first end and a second end which correspond to the first end and the second end of the second pew section;

said second pew section having a second half of a first slidable fastener positioned on the first end of the back section and a second half of a second slidable fastener positioned on the first end of the seat section so as to be engagable with the first half of the first slidable fastener positioned on the second end of the back section of the first pew section and the first half of the second slidable fastener positioned on the second end of the seat section of the first pew section;

said second pew section having a first half of a first slidable fastener positioned on the second end of the back section so as to be engagable with the second half of the first slidable fastener positioned on the first side surface of the second panel member and a first half of a second slidable fastener positioned on the second end of the seat section so as to be engagable with the second half of the second slidable fastener positioned on the first side surface of the second panel member;

wherein each pew section further comprises:

a base frame having a substantially horizontal box shaped top section, said box shaped top section having a generally vertical front surface, a generally vertical back surface, a first side end, a second side end, a top end and a bottom surface, and a plurality of legs extending downwardly from the bottom surface of the box shaped top section;

a first generally L shaped support section, having a bottom surface, a top surface, an outside end, a first leg and a second leg, said bottom surface of the first leg attached to the top end of the top section of the base frame at the first end of said top section;

a second generally L shaped support section substantially identical to the first L shaped support section, having a bottom surface, a top surface, an outside end, a first leg and a second leg, said bottom surface of the first leg attached to the top end of the top section of the base frame at the second end of said top section;

wherein the first leg of the first L shaped support section and said second L shaped support section is contained in a first common plane and the second leg of the first L shaped support section and said second L shaped support section is contained in a second common plane positioned upwardly away from the top section of the base frame at an angle of 95 to 110 degrees;

a substantially horizontal seating section having a front edge, a back edge, a first side edge, a second side edge, a top surface and a bottom surface, said bottom surface attached to the top surface of the first leg of each of the first L shaped support section and the second L-shaped support section;

a generally vertical backrest section having a front edge, a back edge, a first side edge, a second side edge, a front surface and a back surface, said back surface attached to the top surface of the second leg of each of the first L shaped support section and the second L shaped support section;

wherein the first side edge of the seating section and the first side edge of the backrest section are substantially coplanar with the outside end of the first generally L shaped support section; and wherein the second side edge of the seating section and the second edge of the backrest section are substantially coplanar with the outside end of the second generally L shaped support section.

5. A modular pew as in claim 4 wherein a first half of the first slidable fastener and a first half of the second slidable fastener are positioned in each of the outside ends of said first generally L shaped support section and said second generally L shaped support section of said first pew section; and a first half of the first slidable fastener and a first half of the second slidable fastener is positioned in the outside end of said second generally L shaped support section of said second pew section and a second half of the first slidable member and the second half of the second slidable fastener is positioned in the outside end of said first generally L shaped support section of said second pew section.

6. A modular pew as in claim 5 wherein the first half of each first slidable fastener comprises a male bed hook and the first half of each second slidable fastener comprises a pin having a flange, and the second half of each first slidable fastener comprises a plate having an outside surface, and inside surface, and a slot therethrough for detachably receiving the male bed hook, and the second half of each second slidable fastener comprises a plate having a slot and a V shaped notch for detachably receiving the pin having the flange.

7. A modular pew as in claim 6 wherein each pew section is between about 50.8 cm (20 inches) and 152.4 cm (60 inches) in length.

8. A modular pew as in claim 7 wherein the horizontal front surface of said box shaped top section defines a plurality of substantially rectangular holes, said rectangular holes allowing books to pass into and out of the box shaped top section.

9. A modular pew as in claim 8 wherein each of said L shaped support section and the plurality of legs is formed from bentwood;

each of said panel members and the box shaped top section is formed from 21 ply MDF board; and the backrest section and the seating section are formed from bentwood, foam and upholstery cloth.

* * * * *